US005219416A

United States Patent [19]

Rochard et al.

[11] Patent Number: 5,219,416

[45] Date of Patent: Jun. 15, 1993

[54] ELECTRIC END OF RANGE CONTACT WITH CONDITION INDICATION

[75] Inventors: Michel Rochard, Ruelle; Jean-Pierre Guymard, Mansle; Pierre Neau, Le Gond Pontouvre, all of France

[73] Assignee: Telemecanique, Rueil Malmaison, France

[21] Appl. No.: 824,917

[22] Filed: Jan. 22, 1992

Related U.S. Application Data

[63] Continuation of Ser. No. 501,126, Mar. 29, 1990, abandoned.

[30] Foreign Application Priority Data

Apr. 4, 1989 [FR] France ..... 89 04427

[51] Int. Cl.[5] ..... H01H 9/16

[52] U.S. Cl. ..... 200/308; 200/DIG. 42

[58] Field of Search ..... 200/308, 312, DIG. 42

[56] References Cited

U.S. PATENT DOCUMENTS

| | | | |
|---|---|---|---|
| 3,855,959 | 12/1974 | Hinze | 200/308 X |
| 4,052,954 | 10/1977 | Roy | 200/308 X |
| 4,129,766 | 12/1978 | Miyata et al. | 200/308 |
| 4,223,193 | 9/1980 | Iwasaki et al. | 200/308 |
| 4,234,773 | 11/1980 | Nakatani et al. | 200/308 |
| 4,281,228 | 7/1981 | Harmon | 200/308 X |
| 4,301,342 | 11/1981 | Castonguay et al. | 200/308 X |
| 4,352,967 | 10/1982 | Buchtel | 200/308 X |
| 4,877,931 | 10/1989 | Kawase et al. | 200/308 |

FOREIGN PATENT DOCUMENTS

| | | |
|---|---|---|
| 0240399 | 10/1987 | European Pat. Off. . |
| 7803266 | 7/1979 | Fed. Rep. of Germany . |
| 3228469 | 2/1984 | Fed. Rep. of Germany . |

*Primary Examiner*—Henry J. Recla
*Assistant Examiner*—Glenn T. Barrett
*Attorney, Agent, or Firm*—Young & Thompson

[57] ABSTRACT

Elastic devices (3) abruptly actuate a contact carrier (9) in the upward direction when a push-member (1) reaches a tensioning position (E) from a position of rest (R). In the event of any blockage preventing such abrupt movement a lever (24) constrainedly produces the movement when the push-member (1) continues its movement as far as a constrained actuation position (A). The push-member carries colored zones (101, 102). The contact carrier carries a colored zone (104). From the relative position of these zones viewed through a window in the casing (100), the user can adjust the positioning of the limit switch with respect to a movable member intended to actuate it so that the two phases of the actuation take place at the required points. The user can also check whether the contact carrier moves in response to the elastic devices or in response to the lever.

2 Claims, 3 Drawing Sheets

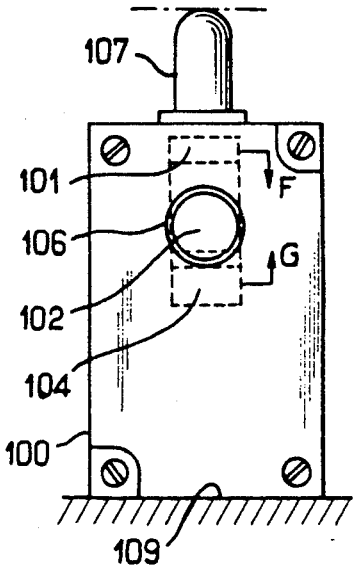
FIG. 2
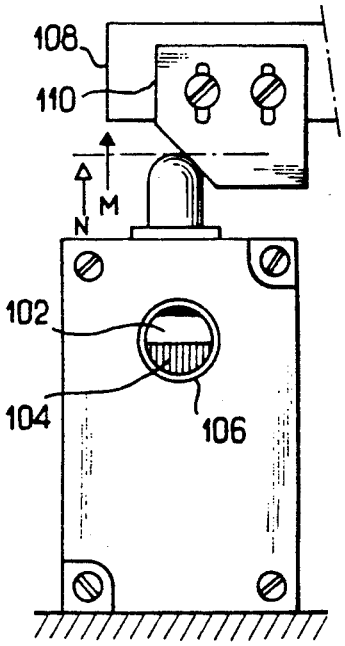
FIG. 3
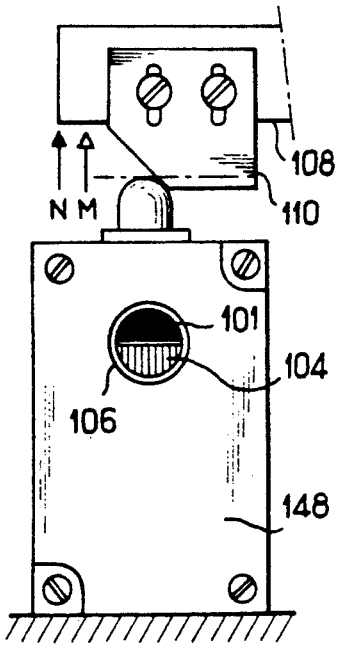
FIG. 4
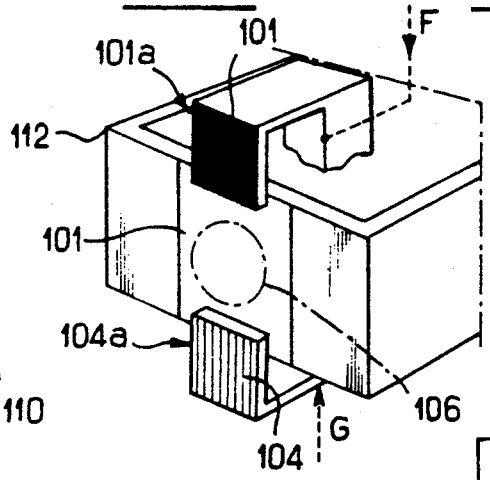
FIG. 6
FIG. 5
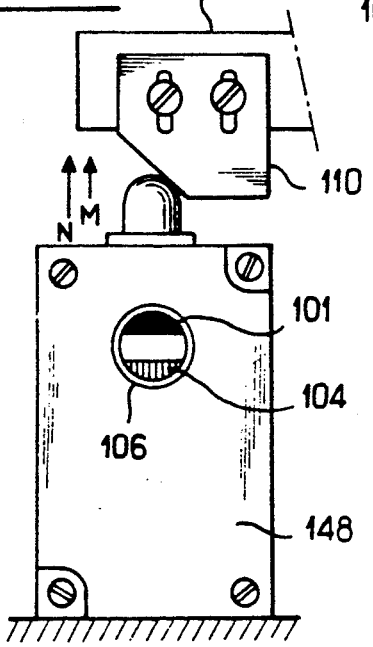
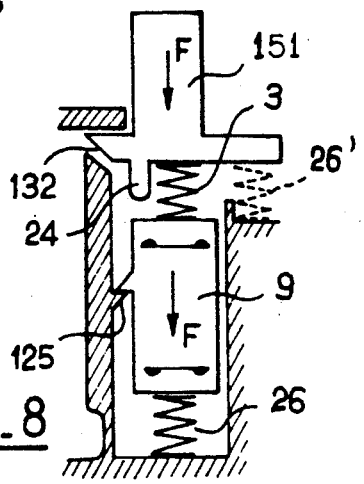
FIG. 8

ELECTRIC END OF RANGE CONTACT WITH CONDITION INDICATION

This application is a continuation, division, of application No. 07/501,126, filed Mar. 29, 1990, now abandoned.

FIELD OF THE INVENTION

This invention relates to a limit switch in which the state of operation is indicated.

BACKGROUND OF THE INVENTION

FR-A- 2 596 197 and corresponding EP-A-0240399 disclose a switch mounted in a casing, in which a driven assembly carrying contacts is abruptly moved in one direction by the expansion of resilient means previously tensioned by the movement of a driving assembly (control push member) which moves parallel to said direction. Transmission means driven by the driving assembly produce a constrained movement of the driven assembly during an additional travel of the driving assembly when the resilient means have not been effective in moving the driven assembly at the end of the initial travel of the driving assembly.

Switches of this kind are usable in installations in which operational reliability or staff safety is dependent upon the breaking of an electric circuit. The resilient means, by their abrupt expansion, break the circuit under optimal conditions (absence of any arcs forming between the contacts). On the other hand, the said resilient means may prove inoperative to break the circuit in the event of a breakage of the resilient means, any jamming, or welding of the contacts if they have been in the closed state for a long time. In that case the transmission means constrain the driven assembly to perform its movement when the driving assembly performs its additional travel.

On installation of such switches it is often necessary to adjust the relative position of the limit switch and the movable member required to act on the driving assembly. The movable member is, for example, a cam fixed to a machine or apparatus component, such cam being required to actuate the limit switch when the component reaches a certain position.

It is fairly complex to position the movable member in such manner that, on the one hand, it can produce normal actuation of the limit switch so that the movable member stops in a reference position and, on the other hand, so that it can give the driving assembly a calibrated additional travel intended for constrained actuation of the driven assembly of the switch, such travel being effected only if the movable member has not stopped in its reference position.

Heretofore, the latter adjustment was carried out by trial and error, for example, by listening to the clicking noise produced on abrupt expansion of the resilient means, and by giving the movable member a slight additional displacement. In other cases, a shim is placed between the movable member and the driving assembly in the maximum driven-in position, the shim thickness being selected on the basis that normal actuation of the switch will take place in the required reference position.

Although a limit switch is already known which has an abrupt operation and positive safety control with display of the position of the driven assembly, it does not allow a check to be made to ensure that the adjustment made enables the driving assembly to perform the additional travel required for constrained actuation in the event of breakdown of the resilient actuating means.

SUMMARY OF THE INVENTION

This invention proposes to equip a limit switch of the kind indicated hereinbefore with simple indicating means which give sufficient information to the installer to enable him to carry out accurate adjustment, without any risk of error, of the relative position of the limit switch and the movable member on installation, and check the operation of the limit switch when it has been installed.

According to the invention, the limit switch with state indication comprising:

- a driving assembly capable of movement between a position of rest and a constrained actuation position on passing through a tensioning position;
- a driven assembly carrying contacts and capable of movement between two switching positions;
- resilient means tensioned by the movement of the driving assembly from its position of rest to its tensioning position and adapted to expand abruptly for causing the driven assembly to perform its said movement when the driving assembly is in the tensioning position;
- transmission means driven by the driving assembly for causing the driven assembly to perform its said movement when the driving assembly moves beyond the tensioning position without the resilient means having produced said movement of the driven assembly;
- means for indicating the movement of the driven assembly, is characterised in that the indicating means are so devised as also to indicate the movement of the driving assembly and allow simultaneous examination of the movements of the two assemblies.

It is thus possible to detect the following states:switch in the position of rest; driven assembly actuated "normally" by the resilient means; driving assembly in the constrained actuation position. This allows accurate adjustment of the relative positioning of the limit switch and the movable member which actuates it so that the switch has the position respectively required in each position of the movable member.

Also, once the limit switch has been installed and is in operation, it is possible to check whether the driven assembly is moving in response to the resilient means before the driving assembly has reached its constrained actuation position or, by contrast, in response to the transmission means after the driving assembly has moved beyond the intermediate tensioning position. In the second case, the switch is defective, and the invention therefore has the advantage of allowing ready detection of such fault.

BRIEF DESCRIPTION OF THE DRAWINGS

Other features and advantages of the invention will be apparent from the following description of various examplary and non-limiting embodiments. In the accompanying drawings:

FIGS. 2 to 5 are elevations of the limit switch according to the invention in three states that the state indicating means can assume when the switch is not damaged, and respectively in a state resulting from damage;

FIG. 6 is a partial perspective view of a second embodiment of the indicating means in which one of the coloured surfaces is immovable;

FIG. 8 is a diagrammatic section of a limit switch with rapid switching and positive break, in which the movements of the two assemblies are in the same direction.

DETAILED DESCRIPTION OF THE INVENTION

Figure 1:
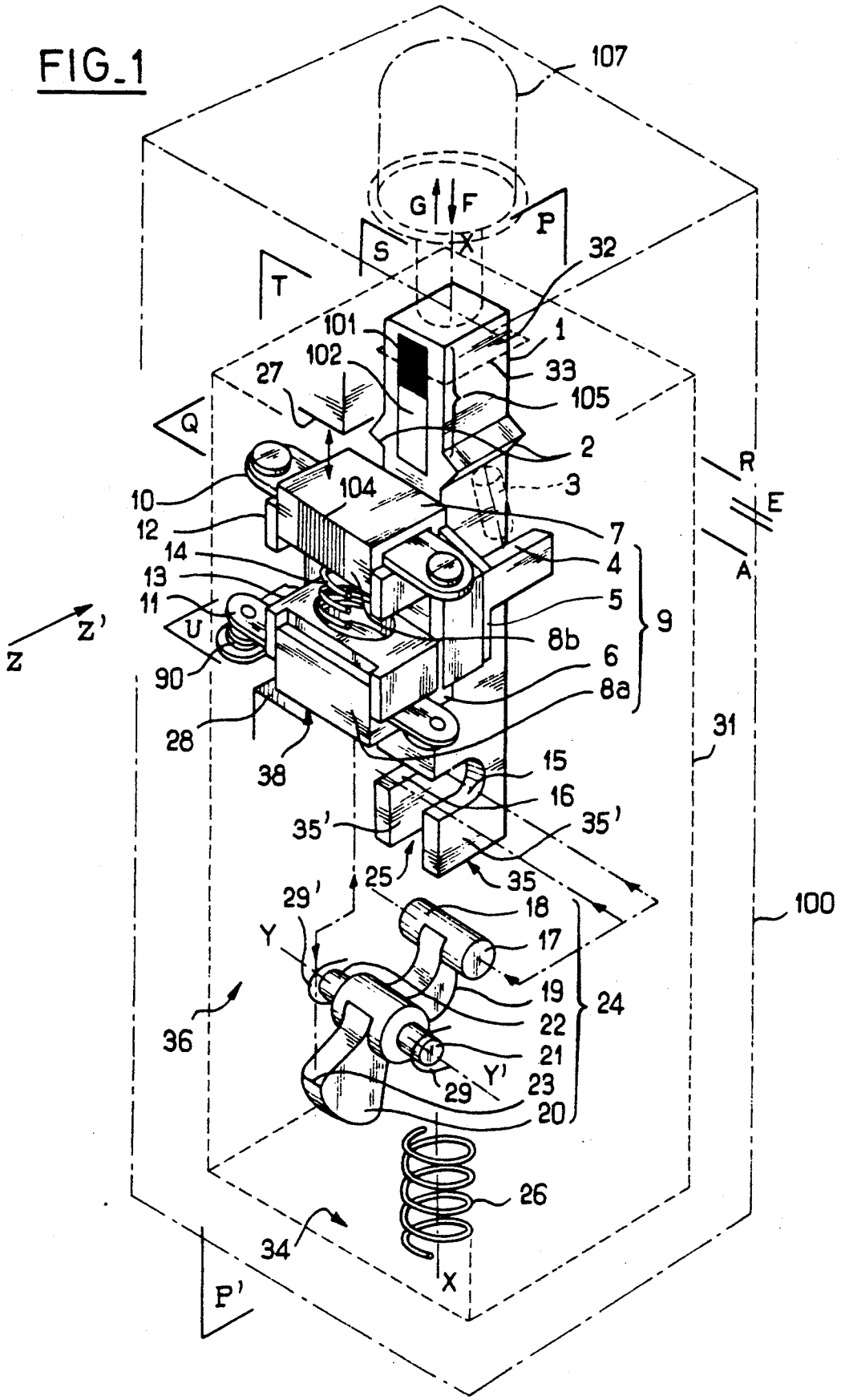
FIG. 1 is a perspective view of the movable members of a limit switch according to the invention, in which the movements of the driving assembly and of the driven assembly are in contrary directions.

The limit switch according to the invention comprises a casing 100, shown in chain lines, made of a body and a lid (not shown in detail), a switch having its own casing 31 shown generally by broken lines. One end 32 of a driving assembly 1 of the switch extends through a top aperture 33 in the casing 31 and receives, from a limit switch actuating push-member 107, longitudinal movements in the directions F and G along the axis XX', which bring it from a position of rest R to a constrained actuation position a, or vice-versa with simultaneous compression or expansion of a return spring 26 disposed between one end 34 of the casing 31 and the other end 35 of the driving assembly 1.

First transverse support members, such as 2, which are carried by the driving assembly symmetrically with respect to a central and longitudinal plane PP' thereof, transmit compressible forces to the ends of bistable devices, such as 3, one of the lines of action of which is shown in chain lines; these devices, which are known per se, and may be of various forms, e.g. a spring actuator, all have the property of expanding abruptly with restitution of the energy that they have accumulated in a spring during a preceeding unstable compression. The supports 2 may be comprised of parallel edges which receive notches provided at one of the ends of the devices 3 so that each support 2 constitutes a pivot for the associated device 3.

Second support means 4, such as parallel edges, which receive other ends of said devices and which are disposed symmetrically with respect to the plane PP', form part of a driven assembly 9 comprising a C-shaped cage with a partition 5 parallel to XX' and perpendicular to the plane PP' and two parallel flanges 6, 7 perpendicular to the axis XX' and terminating in returns **8*a*, 8*b* directed towards one another in the same plane, which form open recesses each adapted to receive a conductive contact bridge 10 and 11 respectively. The partition 5 is widened to carry the members 4 on its back surface remote from the flanges 6 and 7**.

At its ends each bridge carries contact tips which face away from the other bridge. The tips of bridge 10 can engage two fixed contact surfaces disposed in a plane Q. When the tips of bridge 10 are moved away from the plane Q the tips of the bridge 11 can engage two other fixed contact surfaces, one of which is shown by reference numeral 90, disposed in a plane U. These two parallel planes are perpendicular to XX'.

Insulating intermediate members 12, 13 which are applied against the contact bridges in the opposite directions F and G and which are guided along the cage (e.g. along the returns **8*a*, 8*b*) communicate to the bridges thrusts in opposite directions developed by one and the same compression spring 14** disposed between them.

The driven assembly 9 can move parallel to XX' in a plane T between a bottom stable position of rest and a top stable working position. As a result of the presence of the bistable devices 3, these movements are produced abruptly in the directions G and F when the push member moves, even progressively, in the direction F and G respectively from position R to position A and vice-versa; in the direction F corresponding to the driving assembly being driven in from the position of rest, the abrupt movement is produced for a specific position E of the driving assembly which is called "tensioning position" and is intermediate the end positions A and R.

At the end of these movements, the contact bridges 11 and 10 are applied against the fixed contacts for the respective position of rest and working position of the driven assembly 9, which positions are in turn determined when the driven assembly 9 meets fixed stops 28 and 27 respectively of the casing 31.

In the event of the movable contacts of the contact bridge 11 becoming welded against the corresponding fixed contact tips 90 when the driven assembly is in its bottom position of rest, the abrupt switching movement of the driven assembly in the direction G would be rendered impossible when the driving assembly reaches the tensioning position E, for which alignment of the edges 2 and 4 has just been exceeded in the direction F; the impossibility is due to the fact that the elastic devices 3 cannot by themselves develop sufficient forces to break the welds.

In order to achieve constrained lifting of the driven assembly 9 and hence rupture of any welds, a lever 24 receives from the end 35 of the driving assembly 1 a thrust which it communicates in the appropriate direction to the driven assembly if the latter has remained stationary when the driving assembly has cleared the tensioning position E in the direction of the constrained actuation position 1.

Two trunnions 21, 22 on the lever are received in bearings 29, 29' having an axis YY' parallel to and adjacent the plane U, said bearings being stationary with the casing 31. The lever 24 comprises a central control arm 19 projecting between two parallel flanges 35' of the end 35 and comprising two opposite transverse cylindrical projections 17, 18 coupled with two parallel transverse drive grooves 15, 16 in the flanges 35'.

Remote from the arm 19, the lever 24 also comprises a central lifting arm 20 which has an active surface or edge 23 situated opposite the bottom surface 38 of the cage.

In a region 105, the driving assembly 1 has a zone 101 having a recognizable appearance, e.g. by being black, followed, in the direction of the arrow F (direction of its being driven in), by a ground zone 102, e.g. white in colour.

The driven assembly 9 has on a top region of the cage 5, 6, 7, **8*a*, 8*b* which is adjacent the region 105 to a viewer looking along the axis ZZ', a zone 104 having a recognizable appearance differing from that of the zone 101 and of the ground zone 102. In the example, the zone 104 is red in color. The zone 104 is formed on the outer return surface 8*b* of the cage 9. The observer can examine these zones through a sealing-tight and transparent window 106 (FIGS. 2 to 5) of the casing 100, and through an aligned sealing-tight and transparent window in the inner casing 31**.

When the driving assembly 1 is in the position of rest R and hence (except for the case of a breakdown) the driven assembly 9 is in turn in the (bottom) position of rest, only the white ground zone 102 is visible through the two superposed windows (FIG. 2). When the operating member 107 outside the casing communicates its movement to the driving assembly 1 over the range lying between the position of rest R and the tensioning position E, the white zone 102 moves along the window until the time when the driven assembly 9 performs an abrupt upwards switching movement in the direction G.

When this abrupt movement takes place, the red zone 104 will ocupy the bottom half of the window (see FIG. 3) the other half still being occupied by the white ground zone 102.

If a supplementary movement is transmitted to the driving assembly 1 in the direction F, the black zone 101 progressively follows the white zone 102 in the top half of the window (FIG. 4). This additional movement is the one corresponding to the safety travel during which the lever 24 actuates the driven assembly in the direction G if this has not already been done by the resilient devices 3.

Adjustment of the position of a cam 110 intended to actuate the operating member 107 with the casing 100 fixed on a stationary frame or support 109, aims at fulfilling the two following conditions when the movable member 108 carrying the cam is in its required stopped position M: first, the driving assembly must be in the tensioning position E (as indicated by the window in the manner shown in FIG. 3) and, second, the cam must also still have the possibility of driving in the driving assembly as far as the constrained actuation position. In other words, care must be taken to ensure that the actuating member 107 has not already reached the end of the active slope of the cam when the driving assembly has only reached the tensioning position.

For this purpose, the movable member 108 is set to the position M, the cam is adjusted vertically downwards until the red zone 104 occupies the bottom of the window 106. Then, if the cam is adjustable parallel to the direction of movement of movable member 108, a check is made to ensure that the black zone 101 occupies the top half of the window 106 when the movable member 108 is pushed beyond its required stop position to a limit position N.

If not, the cam 110 is adjusted horizontally.

In many cases, for safety reasons, the only position defined is the position N which the movable member must not exceed. The adjustment can then be simplified: all that is required is to set the movable member 108 to position N and adjust the cam 110 so that the zones 101 and 104 both appear in the window.

In the normal course of operation, as soon as the red zone appears, the operator is certain that the movable assembly has moved and it may be assumed that the contacts 11, 90 have separated to produce a stop at M. If this were not the case, the movable member 108 would continue its travel to a limit position N in which the driving assembly would perform its additional travel and would effect constrained opening of these contacts.

In that case, the zones 101 and 104 will appear progressively and substantially symmetrically in the window 106 as shown in FIG. 5, while the member 108 advances from its position M to its position N. Maintenance staff can thus see that the limit switch is defective.

In every case, the black surface associated with the movement of the push-member appears in the window when the travel transmitted to it is sufficient.

The objects of the invention do not exclusively necessitate the use of the means described hereinbefore. As shown in FIG. 6, the white ground zone 102, the presence of which is desirable for contrast with, on the one hand, the red zone and, on the other hand, the black zone, could be carried by a member 112 which is stationary relatively to the casing 31 of the limit switch and in front of which would move two flaps, one, 101*a*, carrying the black zone 101 and the other, 104*a*, carrying the red zone 104, these two flaps being respectively connected to the driving assembly 1 and the driven assembly 9 referred to hereinbefore.

Figure 7:
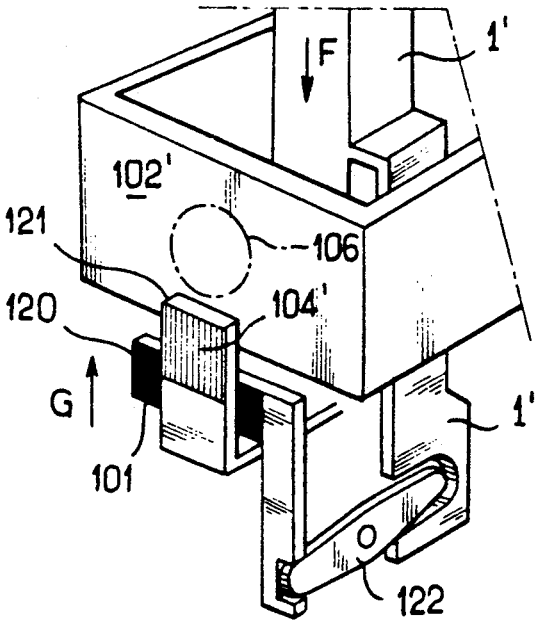
FIG. 7 is a partial perspective view of indicating means using reversal means.

As shown in FIG. 7, there may also be disposed in front of the light-coloured ground zone 102', whether fixed or not, flaps 120, 121 carrying zones 101' and 104' and movable in the same direction G by a suitable mechanical reversal means 122 for the movement of the driving assembly 1' in order to actuate the flap 120. The zone 104' associated with the driven assembly then first appears in the bottom part of the window and then, in the top part of the window 106, the zone 101' emerging from behind the zone 104'.

It is also possible to use an arrangement of the kind described with reference to FIG. 7 in order to obtain zones with opposite movements, as described with reference to FIGS. 1 to 5, in a case in which the assemblies are movable in the same direction. In that case, as shown in FIG. 8, the driving assembly 151 first of all tensions the force accumulating means 3 in the direction F and then abruptly releases in the same direction the contact-carrier driven assembly 9, by lifting a latch 125 by means of a cam 132. The return of the driving and driven assemblies 151 and 9 to the position of rest are in this case effected by springs, as 26, acting on the driven assembly and, possibly, 26' acting on the driving assembly, while the movable colored zones are carried, one by the driven assembly 9, and the other by a flap associated with a movement reversal device as described with reference to FIG. 7.

The transmission means 24 for constrained opening is readily embodied in the form of a lug carried by the driving assembly 151 and engaging the driven assembly 9 when the driving assembly 151 moves beyond its tensioning position without the driven assembly having jumped into the operative position.

Figure 9:
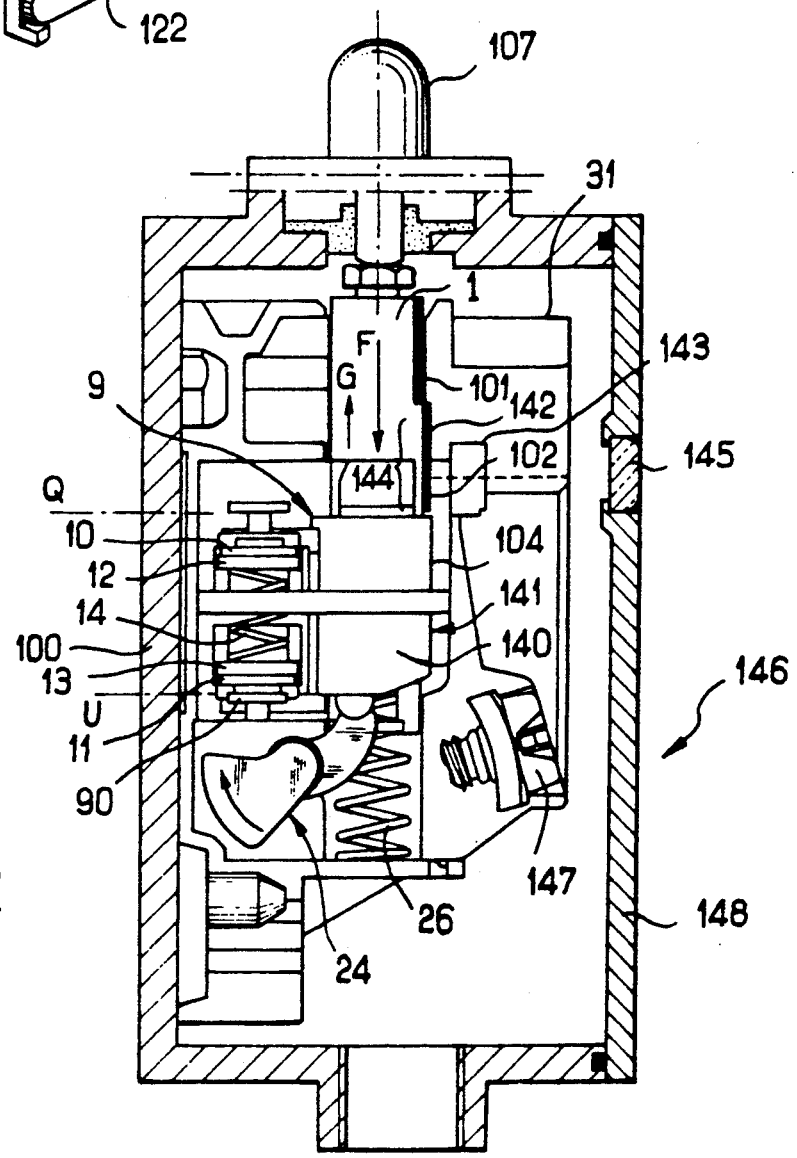
FIG. 9 is a section of one preferred embodiment of the switch according to the invention.

In one specific embodiment of a limit switch incorporating indication of the state on operation, as shown in FIG. 9, and having the general construction shown in FIG. 1, the cage of the driven assembly 9 comprises a thin bush 140 surrounding the driving assembly 1 so as to present a plane surface 141 carrying, for example, a red zone 104, near a plane surface 142 of the push-member carrying the black zone 101 and the white ground zone 102.

These two surfaces 141 and 142 being close to one another, a hatch or magnifying optical means 143 advantageously stationary with the casing 31 of the switch can be disposed opposite the region 144 in which the zone movements take place.

This arrangement has the advantage of disposing the hatch 143 of the casing 31 and the window 145 of the casing 100 on that side of the device 146 to which access is necessary in order to effect the electrical connection of terminals, e.g. 147, by removing a cover 148 provided with the aligned window 145.

It should be noted that the principles on which the means described are based may be embodied by equivalent means. For example, the two movable assemblies provided with coloured surfaces may of course both or separately perform angular movements in the case of pivoting assemblies.

We claim:

1. A limit switch with state indication comprising:

a driving assembly which extends through an aperture in a casing and receives, from a limit switch actuating push member, longitudinal movement between a position of rest and a constrained actuation position on passing through a tensioning position;

a driven assembly which includes both movable contact bridges and fixed contact tips, and is capable of movement relative to the driving assembly between two switching positions;

resilient means tensioned by the movement of the driving assembly from the driving assembly's position of rest to the driving assembly's tensioning position and adapted to expand abruptly thereby to subject the driven assembly to the driven assembly's said movement when the driving assembly is in the tensioning position;

transmission means driven by the driving assembly in order that the driven assembly may perform the driven assembly's said movement when the driving assembly moves beyond the tensioning position without the resilient means having produced the said movement of the driven assembly;

transmission means driven by the driving assembly in order that the driven assembly moves beyond the tensioning movement when the driving assembly moves beyond the tensioning position after the resilient means have produced the said movement of the driven assembly; and indication means for displaying at least part of said movements of both assemblies, said indication means comprising sa window formed in a casing of the limit switch, through which window there appears selectively, depending upon the positions of the assemblies, two zones of different colors each driven by one of the assemblies, thereby to enable visual determination of whether the switch has operated with the aid of the resilient means or the transmission means after said resilient means have failed, or with the transmission means after the resilient means have operated, whereby the time sequence of the movements of the assemblies leading to the operation of the switch can be determined according to the sequence of appearance of the colors of said zones in said window, thereby allowing a simultaneous examination of the movements of said driving and driven assemblies, said simultaneous examination allowing an accurate adjustment and operational check to be made of the limit switch.

2. A switch according to claim 1, wherein one of the zones is connected to a ground zone which is variably covered by the other zone depending on the relative position of the two zones of different color.

* * * * *